US011753593B2

(12) United States Patent
Gates et al.

(10) Patent No.: US 11,753,593 B2
(45) Date of Patent: Sep. 12, 2023

(54) SEPARATION OF VISCOUS OILS INTO COMPONENTS

(71) Applicant: SOLIDEUM INC., Calgary (CA)

(72) Inventors: Ian Donald Gates, Calgary (CA); Jingyi Wang, Calgary (CA)

(73) Assignees: Ian Donald Gates, Calgary (CA); Jingyi Wang, Calgary (CA)

( * ) Notice: Subject to any disclaimer, the term of this patent is extended or adjusted under 35 U.S.C. 154(b) by 0 days.

(21) Appl. No.: 17/637,218

(22) PCT Filed: Aug. 21, 2020

(86) PCT No.: PCT/CA2020/051152

§ 371 (c)(1),
(2) Date: Feb. 22, 2022

(87) PCT Pub. No.: WO2021/035345

PCT Pub. Date: Mar. 4, 2021

(65) Prior Publication Data

US 2022/0298427 A1 Sep. 22, 2022

Related U.S. Application Data

(60) Provisional application No. 62/891,141, filed on Aug. 23, 2019, provisional application No. 62/891,135, filed on Aug. 23, 2019.

(51) Int. Cl.

| | |
|---|---|
| ***C10G 31/06*** | (2006.01) |
| ***C10G 9/14*** | (2006.01) |
| ***C10G 9/18*** | (2006.01) |
| ***C10G 9/00*** | (2006.01) |
| ***C10G 9/24*** | (2006.01) |
| ***C10G 9/36*** | (2006.01) |

(52) U.S. Cl.

CPC ..... *C10G 31/06* (2013.01); *C10G 9/002* (2013.01); *C10G 9/14* (2013.01); *C10G 9/18* (2013.01); *C10G 9/24* (2013.01); *C10G 9/36* (2013.01); *C10G 2300/4006* (2013.01)

(58) Field of Classification Search

CPC . C10G 9/002; C10G 9/14; C10G 9/18; C10G 9/20; C10G 9/206; C10G 9/24; C10G 9/36; C10G 31/06

See application file for complete search history.

(56) References Cited

U.S. PATENT DOCUMENTS

| | | | |
|---|---|---|---|
| 1,627,162 | A | 5/1927 | Egloff |
| 2,604,084 | A | 7/1952 | Sherman |
| 5,445,799 | A | 8/1995 | McCants |

FOREIGN PATENT DOCUMENTS

| | | | |
|---|---|---|---|
| WO | 2012000115 | A1 | 1/2012 |
| WO | 2014146129 | A2 | 9/2014 |

*Primary Examiner* — Renee Robinson
(74) *Attorney, Agent, or Firm* — Dickinson Wright PLLC

(57) ABSTRACT

The invention provides methods for treating a source oil phase consisting of heavy oil, bitumen, a mixture of heavy oil and bitumen, a mixture of solvent and heavy oil or bitumen or both. The method comprises: introducing the source oil phase to a lower reservoir section of a device, flowing the source oil phase through an array of vertically extending heated pipes with an inert gas so as to thermally separate a vaporized light oil phase component from a heated liquid source oil phase, and segregating fluid flows by density in an upper fluid separating manifold to provide a light product fluid and a heavy product fluid.

18 Claims, 4 Drawing Sheets

SEPARATION OF VISCOUS OILS INTO COMPONENTS

CROSS-REFERENCE TO RELATED APPLICATIONS

This application is a U.S. National Stage of International Application No. PCT/CA2020/051152, filed on Aug. 21, 2020, which claims the benefit and priority of U.S. Patent Application No. 62/891,135, filed on Aug. 23, 2019, and U.S. Patent Application No. 62/891,141, filed on Aug. 23, 2019, the entire contents of which are incorporated herein by reference.

FIELD OF THE INVENTION

The invention is in the field of methods for separating light components from a oil from heavy oil components or for raising the flash point of an oil.

BACKGROUND OF THE INVENTION

Typically, petroleum substances of high viscosity and density are one of two categories: "heavy oil" and "bitumen". Commonly, "heavy oil" is defined as a petroleum that has a mass density of between about 920 kg/m$^3$ (or an API gravity of about 26°) and 1,000 kg/m$^3$ (or an API gravity of about 10°). Bitumen, or extra heavy oil, is typically defined as that portion of petroleum that exists in the semi-solid or solid phase in natural deposits, with a mass density greater than about 1,000 kg/m$^3$ (or an API gravity of about 10° or lower) and a viscosity greater than 10,000 centipoise (cP or 10 Pa.$) measured at the original temperature of the deposit and atmospheric pressure, on a gas-free basis. Although these terms are in common use, references to heavy oil and bitumen represent categories of convenience, and there is a continuum of properties between heavy oil and bitumen. Accordingly, references to heavy oil and/or bitumen or extra heavy oil herein include the continuum of such substances, and do not imply the existence of some fixed and universally recognized boundary between the two substances. In particular, the term "heavy oil" includes within its scope all "bitumen" including hydrocarbons that are present in semi-solid or solid form. Similarly, a "bituminous" material is one that includes a bitumen component, as that component is broadly defined.

In many heavy oil processing systems, heavy oil or bitumen is mixed with a lighter solvent to make it easier for processing e.g. separation from water or for transportation e.g. obtaining a petroleum liquid which can be easily transport in a pipeline. Often solvent, typically composed of paraffin or naphtha solvents, are mixed with viscous heavy oils or bitumen to enable easier separation from water when the heavy oil or bitumen is produced from the reservoir. In other systems, solvent is added to the heavy oil or bitumen so that the mixture of the oils can reach the specifications for oil that can be readily transported in pipelines. In its original state, heavy oil or bitumen is too viscous to be pumped in pipelines. For example, in some pipelines, the oil must have viscosity that is equal or lower than 250 or 350 cSt.

In other systems, the solvent is added to the bitumen as one component of the recovery process to extract the heavy oil or bitumen from the reservoir originally containing the oil. The in situ viscosity of the heavy oil or bitumen is too high for it to be produced under primary production technologies from the reservoir and thus, it is required that the viscosity of the heavy oil or bitumen is lowered to a value so that it can be produced by normal forces from the reservoir. Such forces include pressure drive as would be the case when a high pressure material is injected into the reservoir and fluids are produced from the reservoir. The pressure difference between the injection well(s) and the production well(s) leads to a pressure difference that can move fluids through the reservoir and produce them from the reservoir to the surface. Another force that can move reservoir fluids, including oil, are gravity drainage where a density difference between fluid phases in the reservoir are sufficient to drain liquid oil to a production well. Another example of a force is solution gas drive where exsolved gas expands and displaces reservoir fluids towards a production well. The addition of solvent to the reservoir and subsequent mixing of the solvent with the heavy oil or bitumen lowers the viscosity of the oil phase which then has a lower viscosity than that of the original heavy oil or bitumen which then enables production of the solvent-heavy oil/bitumen mixture to the surface due to its reduced viscosity.

Often solvents used in the processing or treatment of heavy oil or bitumen are obtained from natural gas condensates or petroleum distillates, or from light crude oils.

Many heavy oils and bitumen consist of not only viscous components such as asphaltenes but also lighter oil components. These light ends are composed of saturate (alkane) and aromatic components and typically have viscosities lower than that of the asphaltenic component. Upon heating of heavy oil or bitumen, reactions occur that can break bonds in the heavy components of the heavy oil and bitumen leading to the generation of lighter materials such as saturate and aromatic components. These components, when mixed with the original heavy oil and bitumen, can lead to an upgraded oil product with lower viscosity than that of the original heavy oil or bitumen.

There is an ongoing need for improved methods that are both relatively efficient and simple to separate solvents from mixtures of solvents and heavy oil or bitumen.

There is an ongoing need for improved methods to raise the flash point of oil mixtures.

There is also an ongoing need for improved methods that are both relatively efficient and simple for thermally cracking heavy oil or bitumen or mixtures of solvents and heavy oil or bitumen to yield a lighter low viscosity oil phase and a viscous heavy oil phase.

SUMMARY OF THE INVENTION

In one aspect of the invention, a method and apparatus are provided that take advantage of heating a heavy oil or bitumen or a mixture of solvent and heavy oil or bitumen, each option referred to as the source oil phase, to temperatures between 280 and 600° C. in an inert gas environment where oxidation is prevented. At these elevated temperatures, the lighter components in the source oil phase will boil off at the prevailing pressure and be vaporized within the apparatus. Furthermore, at elevated temperatures, the source oil phase within the apparatus will thermally crack (pyrolyze) with larger molecules breaking into smaller molecules. This increases the yield of a light oil phase which vaporizes within the apparatus.

The other product of the separation or reactions is a residual heavy oil phase.

The lighter components are generally composed of relatively low molecular weight alkanes (linear hydrocarbons up to C40 alkanes and potentially above) and aromatics (cyclic hydrocarbons up to C40 aromatics and potentially above).

With the addition of methane or hydrogen to the oil, further components of the oil may be decomposed into smaller molecules yielding an upgraded oil product.

The apparatus has both internal heating surfaces that provide heat to the oil. The light oil components and inert gas can be cooled within the apparatus and the condensed light oil phase directed to a collection lipped balcony within the apparatus and is removed from the apparatus.

Alternatively, the light oil components and inert gas can be removed from the device and cooled and condensed in a separate apparatus.

The inert gas environment within the apparatus has no oxygen within it which prevents oxidation (combustion) of the oil components within the apparatus.

The remaining residual heavy oil phase that results from the separation of light end components from the source oil phase or from the reactive generation (thermal cracking/pyrolysis) of light end components from the source oil phase apparatus is collected from the bottom of the apparatus. The residual heavy oil phase can be a feedstock for asphalt or other carbon-based products.

Methods are accordingly provided for separating a source oil phase (heavy oil or bitumen or a mixture of solvent and heavy oil or bitumen or both) into a light end oil phase and a residual heavy oil phase by either evaporation of the lighter components from the source oil phase or reactive generation of light oil components by thermal cracking or pyrolysis or both.

The methods involve the use of heat transfer pipes within the apparatus within the device to accelerate the conversion of oil components in the original oil phase to vaporized oil components and thermally cracked components that are vaporized and are then separated from the source oil phase. The temperature of the inert gas can be provided to the device at relatively hot conditions to accelerate separation of the light end components in the device.

In alternative aspects, the operating temperatures (heating and cooling) and pressure of the unit can be altered to tune the yield of the light end product (the fractional amount of condensed light end oil phase produced) from the method.

In other alternative aspects, the operating temperatures (heating and cooling) and pressure of the unit can be adjusted to calibrate the density and properties of the residual heavy oil phase that results from the process.

A methods are according provided for treating a source oil phase consisting of heavy oil, bitumen, a mixture of heavy oil and bitumen, a mixture of solvent and heavy oil or bitumen or both, comprising:

Introducing the source oil phase to a reservoir section within the device above which there are an array of pipes;

Flowing the source oil phase into the array of heated pipes within the device where the heated pipes are of radius and length so that the residence time can be specified;

Heating the source oil phase so as to physically separate a light oil phase components from the source oil phase through heated pipes within the device;

Generating light oil components in vaporized form within the heated pipes; Condensing and removing the light end components from the device in the upper section of the device where the fins direct the condensed liquid to the light end collection system;

Flowing the residual heavy oil phase from a collection area above the array of pipes to a collection point;

Introducing an inert gas component into the bottom of the device to help move light end components from the device;

Injecting a cool inert gas into the top of the device to help cool the upper section of the device which also helps to motivate the light oil phase product through the light end collection system; and Collecting the residual heavy oil phase from the device.

In alternative aspects, methods are provided wherein heating to the device is provided from any combination of electrical resistance heating, induction heating, heat tracing, and hot fluid heating either within a pipe or directly into the source oil phase.

In alternative aspects, methods are provided wherein heating to the device is preferably provided by using induction heating directly around the pipes.

In alternative aspects, methods are provided wherein the temperature of the heated pipes is between about 280 and 600° C.

In alternative aspects, methods are provided wherein the temperature of the heated pipes is preferably between about 350 and 550° C.

In alternative aspects, methods are provided wherein the upper cooling section is maintained at a temperature between about 20° C. and 200° C.

In alternative aspects, methods are provided wherein the cooling inert gas is composed of nitrogen, carbon monoxide, carbon dioxide, methane, ethane, propane, hydrogen, combustion flue gas, or mixtures thereof.

DETAILED DESCRIPTION OF THE INVENTION

Methods are provided to separate a light oil phase and residual heavy oil phase from a source oil phase (either heavy oil, bitumen, or a mixture of solvent and heavy oil or bitumen or both) where an inert gas is introduced into the device that contains internal cooling fins that direct the condensed light end components to a collection system within the device. This can be used to provide a value-added light oil component from a heavy oil or bitumen or mixture of the two or a mixture of one or both with solvents.

Figure 1:
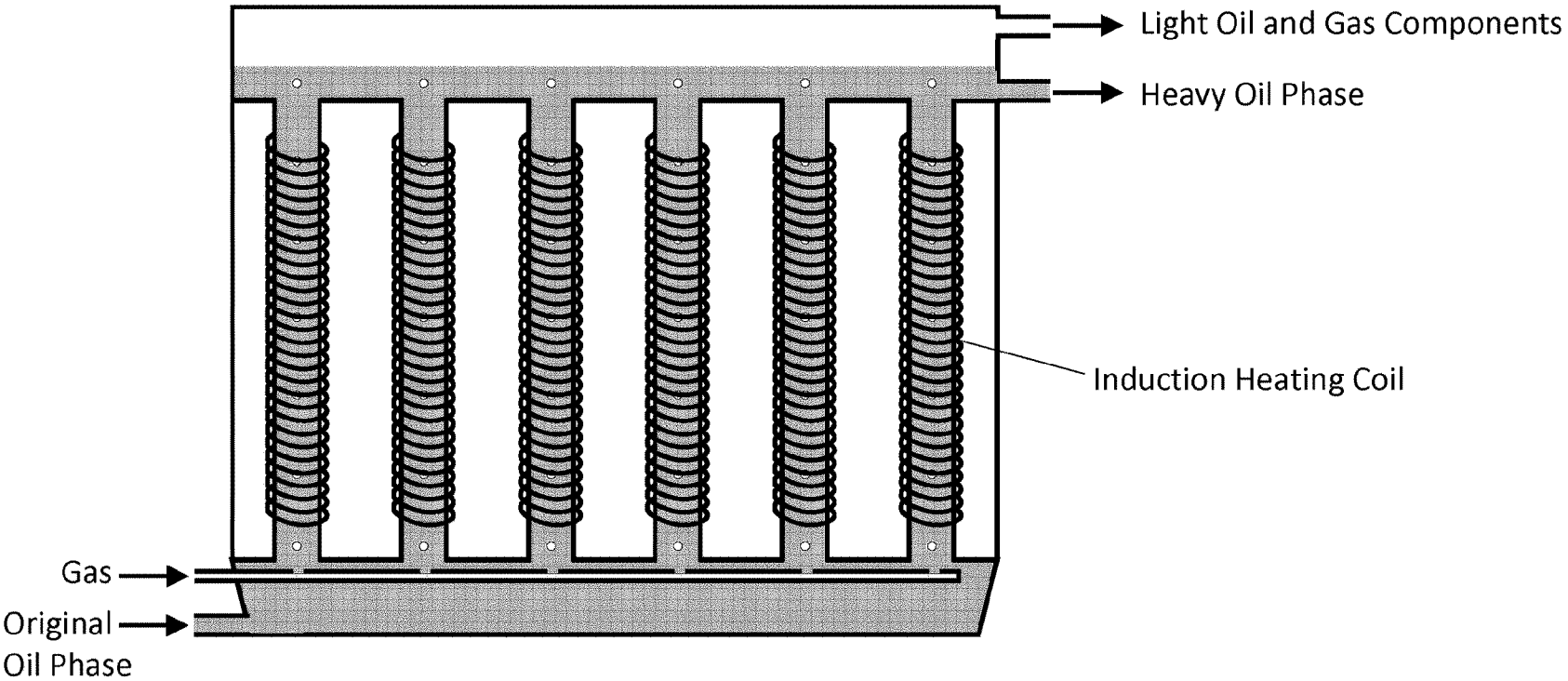
FIG. 1 is a diagram exemplifying one implementation of the methods described herein for treating a source oil phase and converting it into a light oil phase and a residual heavy oil phase.

FIG. 1 displays one embodiment of the device. The source oil phase enters the device into the heated section of the device where the temperature is between 280 and 600° C. The heating to internal pipes in the device can be provided from an induction heaters. An hot inert gas can be injected into the bottom of the device to aid in mixing of the heated oil and to help heat the oil.

In the device taught here, the light oil components and gas can be removed from the unit and cooled to yield a gas (the original inert gas) and a liquid light oil component mixture.

If needed, a relatively cool inert gas can be introduced to the top part of the device to aid with cooling.

The inert gas is preferentially any gas that is absent of oxygen. This includes nitrogen, flue gas, hydrogen, methane, carbon dioxide, flue gas, and mixtures thereof.

In some implementations, the inert gas introduced to the device is at lower temperature than the hot section of the device.

Figure 2:
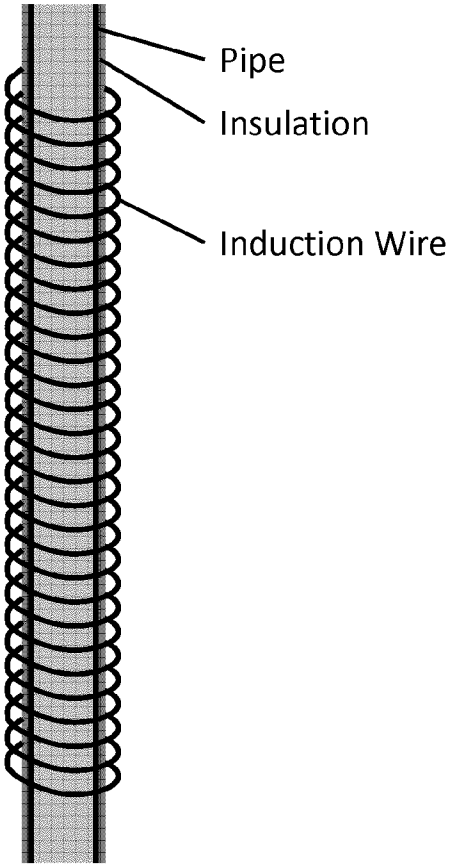
FIG. 2 is a diagram exemplifying the design of the heating system using an induction heater.

FIG. 2 illustrates the heating coil design for the induction heater which can yield temperatures between 280 and 600° C. The heated oil generates vapors by two physical consequences. First, the light end components in the source oil phase are vaporized due to sufficient latent heat being supplied that boils off the light end components. Second, the source oil phase components, especially the larger, heavy molecules, are broken down by thermal cracking (pyrolysis) into light end components that then are boiled off from the liquid in the heated zone of the device.

In FIG. 1, the vaporized light end components rise through the pipes into the upper section of the device.

The flow of the inert gas within the device helps to move the liquid light ends from the device.

The heaters surrounding the pipes can consist of conductive heating through the device wall from electrical resistance heaters (e.g. heat tracing tape or lines), electrical induction heaters (with induction heating plates), injection of hot inert or flue gas (for example the product of combustion of a fuel) external to the pipes, or steam-based heating where steam pipes are placed within the heated source oil, or heated fluid (for example hot oil or hot flue gas) heating.

Figure 3:
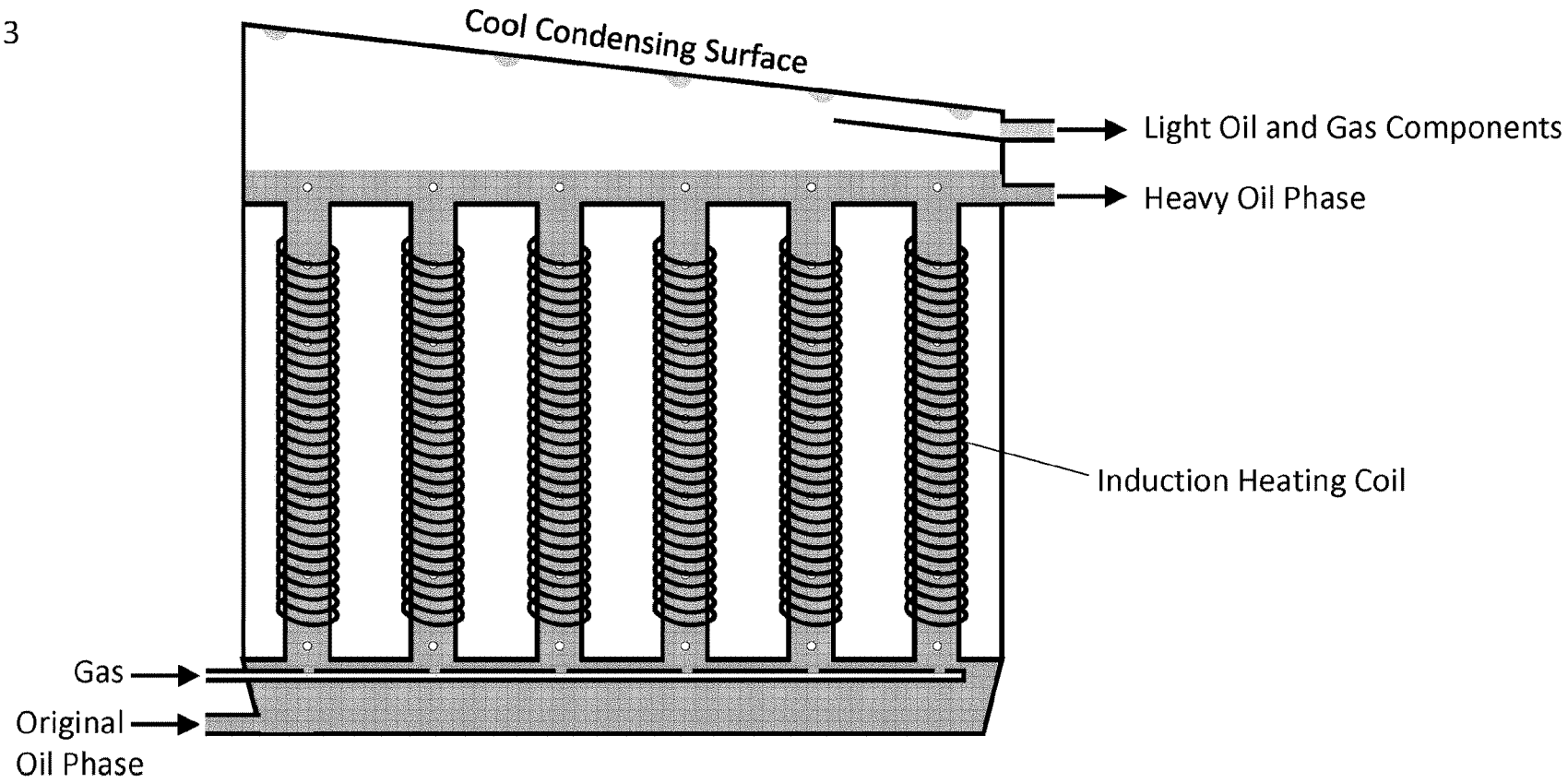
FIG. 3 is a diagram exemplifying another implementation of the methods described herein for treating a source oil phase and converting it into a light oil phase and a residual heavy oil phase.

FIG. 3 illustrates another implementation of the present methods for treating a source oil phase where the top part of the device serves as a condensing surface for the light end components. The light end components cool down in the top section and subsequently condense on the internal cooling funs and external cooling surfaces which then direct the condensed liquid to the collection pool from which the liquid light end components are removed from the device. The top section of the device is kept cooler than about 200° C. and preferably lower than 160° C.

Figure 4:
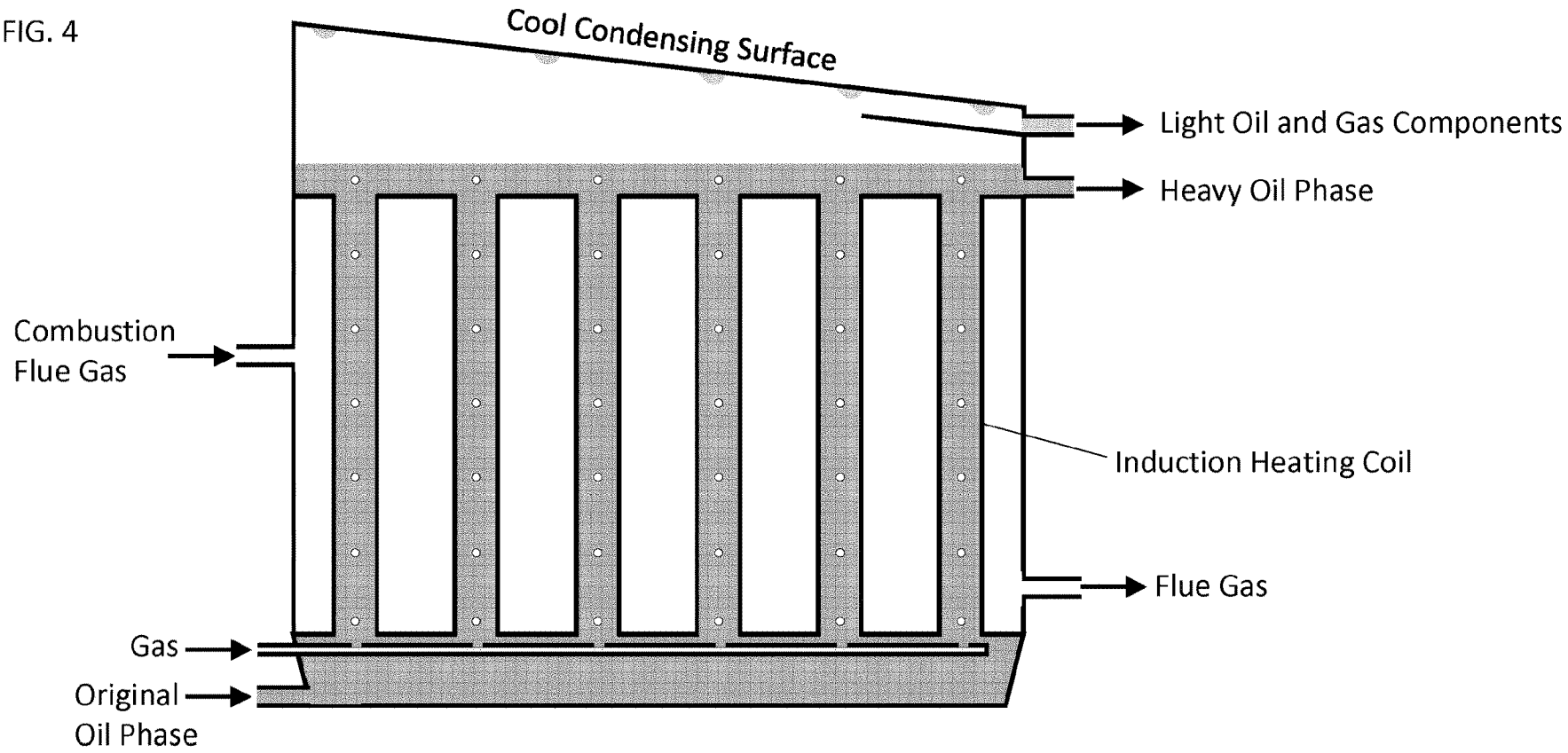
FIG. 4 is a diagram exemplifying another implementation of the methods described herein for treating a source oil phase and converting it into a light oil phase and a residual heavy oil phase.

FIG. 4 illustrates another implementation of the present methods for treating a source oil phase where heating of the pipes is provided by hot gas flowing around the external surfaces of the pipes The internal surfaces of the device can be coated with a oleophobic substrate.

The inert gas injection may also contain hydrogen which can be used to produce greater amounts of the light oil phase product.

The residence time of the source oil phase in each pipe is to be of order of seconds to hours, preferably of the order of minutes to tens of minutes.

The number of pipes can be adjusted to meet the required source oil flow rate.

The radius of the pipes is to be of order of 0.1 to 5 inches, preferably of the order of 1 to 2 inches.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

What is claimed is:

1. A method of treating a source oil phase comprising a heavy oil, a bitumen, a mixture of heavy oil and bitumen, or a mixture of solvent and heavy oil or bitumen or both, the method comprising:

introducing the source oil phase to a lower reservoir section within a housing defining a device, the lower reservoir section of the device being in fluid communication with an array of vertically extending pipes above the reservoir section, the array of pipes extending vertically to fluidly connect the lower reservoir section of the device with an upper fluid separating manifold;

flowing the source oil phase through the reservoir section into the array of pipes while heating the pipes, to provide heated pipes, wherein the heated pipes are sized to provide a selected residence time of flowing source oil within the pipes;

heating the source oil phase within the heated pipes so as to thermally separate a vaporized light oil phase component from a heated liquid source oil phase within the heated pipes, to provide a vaporized light oil phase;

introducing an inert gas into the lower reservoir section of the device so as to direct the inert gas into the heated pipes in a concurrent fluid flow with the heated liquid source oil phase and thereby admix the flowing inert gas in the heated pipes with the vaporized light oil phase component therein, motivating the flow of heated fluids out of the array of heated pipes and into the upper fluid separating manifold;

segregating fluid flows by density in the upper fluid separating manifold, to provide a light product fluid comprising the vaporized light oil phase and inert gas components and a heavy product fluid comprising a residual heavy oil phase;

separately collecting the light product fluid and the heavy product fluid from the upper fluid separating manifold.

2. The method of claim 1, further comprising injecting a cooling inert gas into the upper fluid separating manifold so as to cool fluids in the manifold and thereby motivate the separation of the light product fluid from the heavy product fluid.

3. The method of claim 2, where the cooling inert gas is composed of nitrogen, carbon monoxide, carbon dioxide, methane, ethane, propane, hydrogen, combustion flue gas, or mixtures thereof.

4. The method of claim 1, where heating the source oil phase within the heated pipes is provided by one or more of electrical resistance heating, induction heating, heat tracing, or hot fluid heating either within a pipe or directly into the source oil phase.

5. The method of claim 4, where heating is provided by the induction heating directly of the heated pipes.

6. The method of claim 1, where the temperature of fluid in the heated pipes is between about 280 and 600° C.

7. The method of claim 1, where the temperature of fluid in the heated pipes is between about 350 and 550° C.

8. The method of claim 1, wherein heating of the fluid in the heated pipes comprises thermally cracking the source oil so as to generate an additional fraction of vaporized light oil.

9. The method of claim 1, wherein fluid in the upper fluid separating manifold is maintained at a temperature of between about 20° C. and 200° C.

10. A device adapted for treating a source oil phase comprising a heavy oil, a bitumen, a mixture of heavy oil and bitumen, or a mixture of solvent and heavy oil or bitumen or both, the device comprising:

a source oil phase inlet into a lower reservoir section within a housing defining the device, the lower reservoir section of the device being in fluid communication with an array of vertically extending pipes above the reservoir section, the array of pipes extending vertically to fluidly connect the lower reservoir section of the device with an upper fluid separating manifold;

a heater disposed to heat flowing source oil within the array of pipes, thereby providing heated pipes, wherein the heated pipes are sized to provide a selected residence time of flowing source oil within the pipes so as to permit thermal separation of a vaporized light oil phase component from a heated liquid source oil phase within the heated pipes, to provide a vaporized light oil phase;

an inert gas inlet into the lower reservoir section of the device positioned so as to direct the inert gas into the heated pipes in a concurrent fluid flow with the heated liquid source oil phase and thereby admix the flowing inert gas in the heated pipes with the vaporized light oil phase component therein, motivating the flow of heated fluids out of the array of heated pipes and into the upper fluid separating manifold;

outlet ports for separately collecting a light product fluid and a heavy product fluid from the upper fluid separating manifold, where the product fluids are segregated by density in the upper fluid separating manifold, wherein the light product fluid comprises the vaporized light oil phase and inert gas components and the heavy product fluid comprises a residual heavy oil phase.

11. The device of claim 10, further comprising a cooling inert gas inlet into the upper fluid separating manifold positioned so as to cool fluids in the manifold and thereby motivate the separation of the light product fluid from the heavy product fluid.

12. The device of 11, where the cooling inert gas is composed of nitrogen, carbon monoxide, carbon dioxide, methane, ethane, propane, hydrogen, combustion flue gas, or mixtures thereof.

13. The device of claim 10, where the heater heating the flowing source oil phase within the heated pipes is one or more of an electrical resistance heater, an induction heater, a heat tracing, or a hot fluid heating system.

14. The device of claim 13, where the heater is the induction heater, positioned to directly heat the heated pipes.

15. The device of 10, where heater is adapted to provide a temperature of fluid in the heated pipes of between about 280 and 600° C.

16. The device of 10, where the heater is adapted to provide a temperature of fluid in the heated pipes of between about 350 and 550° C.

17. The device of 10, wherein device is configured so that heating of the fluid in the heated pipes comprises thermally cracking the source oil so as to generate an additional fraction of vaporized light oil.

18. The device of 10, wherein the upper fluid separating manifold is configured to maintained fluid therein at a temperature of between about 20° C. and 200° C.

* * * * *